US006149261A

United States Patent [19]

Kuwabara et al.

[11] Patent Number: 6,149,261

[45] **Date of Patent: *Nov. 21, 2000**

[54] SUCTION PRIMING OF A NEWLY EXCHANGED INK CONTAINER

[75] Inventors: Nobuyuki Kuwabara, Kawasaki; Hiroshi Tajika; Kazuhiro Nakajima, both of Yokohama; Shuichi Murakami, Tokyo; Tamaki Sato, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/689,684

[22] Filed: Aug. 13, 1996

Related U.S. Application Data

[63] Continuation of application No. 08/174,445, Dec. 28, 1993, abandoned.

[30] Foreign Application Priority Data

| | | | |
|---|---|---|---|
| Dec. 28, 1992 | [JP] | Japan | 4-347438 |
| Dec. 28, 1992 | [JP] | Japan | 4-347439 |
| Jun. 30, 1993 | [JP] | Japan | 5-160889 |

[51] Int. Cl.[7] ..... B41J 2/165

[52] U.S. Cl. ..... 347/30

[58] Field of Search ..... 347/22, 23, 29, 347/30, 31, 32, 33, 35, 19

[56] References Cited

U.S. PATENT DOCUMENTS

| | | | |
|---|---|---|---|
| 4,144,537 | 3/1979 | Kimura et al. | 347/32 |
| 4,739,340 | 4/1988 | Terasawa | 347/30 |
| 4,745,414 | 5/1988 | Okamura et al. | 347/30 |
| 4,819,012 | 4/1989 | Kiyohara et al. | 347/30 |
| 4,970,534 | 11/1990 | Terasawa et al. | 347/32 |
| 4,999,643 | 3/1991 | Terasawa | 347/30 |
| 5,068,674 | 11/1991 | Sato et al. | 347/62 |
| 5,103,244 | 4/1992 | Gast et al. | 347/33 |
| 5,109,233 | 4/1992 | Nishikawa | 347/12 |
| 5,148,203 | 9/1992 | Hirano | 347/30 |
| 5,153,613 | 10/1992 | Yamaguchi et al. | 347/30 |
| 5,565,899 | 10/1996 | Sugimoto et al. | 347/30 |

FOREIGN PATENT DOCUMENTS

| | | | |
|---|---|---|---|
| 0448967 | 10/1991 | European Pat. Off. . | |
| 0535686 | 4/1993 | European Pat. Off. . | |
| 551752 | 7/1993 | European Pat. Off. | 347/23 |
| 0553561 | 8/1993 | European Pat. Off. . | |
| 5-31909 | 2/1993 | Japan | 347/23 |
| 51-69675 | 7/1993 | Japan . | |

*Primary Examiner*—John Barlow
*Assistant Examiner*—Charles W. Stewart, Jr.
*Attorney, Agent, or Firm*—Fitzpatrick, Cella, Harper & Scinto

[57] ABSTRACT

An ink jet apparatus, used with an exchangeable ink jet cartridge having an ink jet head and an ink container, includes a cap, a sucking device and a controller. When the cap caps the ejection orifices of the recording head, the sucking device sucks ink from the ejection orifices. The controller controls the operation of the cap and sucking device. After a sucking operation is performed, the cap is held away from the ejection orifices for a predetermined duration of time; the capping and sucking operations are then repeated.

9 Claims, 11 Drawing Sheets

| PERIOD \ T | ~5°C | 5~30°C | 30°C~ |
|---|---|---|---|
| A | 24 HRS | 24 HRS | 24 HRS |
| B | 240 HRS | 72 HRS | 48 HRS |

SUCTION PRIMING OF A NEWLY EXCHANGED INK CONTAINER

This application is a continuation of application Ser. No. 08/174,445 filed Dec. 28, 1993 now abandoned.

FIELD OF THE INVENTION AND RELATED ART

The present invention relates to an ink jet apparatus and performance recovery means for the ink jet apparatus, in particular to an ink jet apparatus comprising an exchangeable ink container and/or an exchangeable recording head, and means for preventing or correcting effectively the ejection failure which occurs at the beginning of the ink jet recording operation immediately after the ink container is exchanged, and the performance recovery means for such an ink jet apparatus.

As for an ink jet recording apparatus, some of them comprises a semi-permanently usable recording head (herein after, built-in recording head) which is unexchangeably assembled into the apparatus and an exchangeable ink cartridge which stores ink and is connected to the built-in recording head through a tube to supply the built-in recording head with the stored ink. However, it is rather difficult to eliminate completely the problems involving the built-in recording head, such as occasional malfunctioning due to foreign matter plugging the ejection orifices or durability related malfunctioning due to the deterioration of the energy generating member for generating the energy for ejecting the ink; therefore, it is generally required to establish a specific maintenance service system for maintaining the recording performance, that is, for assuring the reliability of the recording apparatus itself for a long period.

On the other hand, an ink jet recording apparatus, the cost of which is reduced to appeal to the general market, uses an integrated recording/ink container cartridge (hereinafter, exchangeable integrated cartridge) in which the recording head and ink container is integrated so that this integrated cartridge can be easily and reliably exchanged for every predetermined amount of ink consumption.

Generally speaking, the ink jet recording head used in this type of ink jet recording apparatus is provided with nozzles arranged with a pitch of 180/inch, 240/inch, or the like. During the non-recording time, that is, when the ink jet recording head is on standby, the recording liquid evaporates from the ejection orifices of these nozzles and as a result, the viscosity of the recording liquid adjacent to these orifices increases. When this happens, ejection failure may occur at the beginning of the following image recording operation. In other word, failures such as dot drop-out, positional deviation which occurs as the recording liquid droplet land on the recording medium, occurs, rendering thereby the recorded image to be unclear or incomplete.

In the past, the following countermeasures have been taken; a cap made usually of elastic material such as rubber is placed in contact with the surface where the ejection orifices of the nozzles are arranged (hereinafter, ejection surface) so that the recording liquid is prevented from evaporating from the ejection orifices while the ink jet recording head is on standby; means is provided for ejecting the recording liquid for a predetermined period, outside the recording range, with no relation to the actual recording operation (hereinafter, preliminary ejection), so that the recording liquid with the increased viscosity which is present adjacent to the ejection orifices is discharged in advance out of the ink jet recording head before the beginning of the recording operation to prevent the production of poor recording images. Further, as the evaporation of the recording liquid and resultant viscosity increase reaches a further advanced level, means such as the following is generally employed; the recording liquid within the nozzles is forced out by sucking the recording liquid through the cap, or applying pressure to the recording liquid through the ink supplying system of the ink jet recording head, so that the recording liquid within the nozzles is replaced by fresh recording liquid (hereinafter, "sucking" and "pressuring" are combinedly called "recovery operation"), and thereafter, the actual recording operation is initiated.

Now, from the standpoints of reliability of the exchangeable integrated cartridge and in consideration of the limitation of the size and weight thereof, the amount of the ink to be stored in the ink container cannot be too large. This causes annoyance for users such that running cost becomes higher or such that when the ink container is to be exchanged after the ink is depleted, the recording head, being integral with the ink container, is forced to be also exchanged even if it is still satisfactorily functioning, which is a problem to be solved in view of the world wide concern for environmental protection.

Therefore, in order to maintain advantages of the characteristics of the exchangeable integrated cartridge while taking into consideration the global concern for environmental protection and the problem of cost increase, a different type of exchangeable cartridge (hereinafter, separable exchangeable cartridge) has been proposed, in which the ink jet recording head is made separable from the ink container for storing the ink to be supplied to the ink jet recording head.

When a separable, exchangeable cartridge having the above described structure is used, that is, when the recording head and ink container are joined, continuous ink flow must be generated between two components. In other words, the continuous flow must be created using some means. At this time, it is preferable to use the aforementioned recovery operation as means for establishing communication between the recording head and ink container since this arrangement does not require a specifically dedicated means.

However, this arrangement brings forth problems as will be described hereinafter. That is, since the recording head and ink container are of the separable-exchangeable type, the connecting tube of the recording head, with which the recording head and ink container is connected, is provided with a mesh filter in order to prevent foreign matter or the like from entering the recording head from the outside or the joined ink container. When the ink container is replaced, the entire surface of this filter comes to be exposed to the air, whereby the ink adjacent to the filter may be lost by evaporation or the like. When a new ink container is joined with the recording head under such a condition, it results in the presence of an air layer at the joint. When the aforementioned recovery operation is carried out with the presence of an air layer near the filter, to create the continuous ink flow between the recording head and the fresh ink container, all the filter surface does not begin at once to pass the ink. Instead, the ink flow is established through a portion of the surface where the ink can most easily pass. After the establishment of such a partial ink flow, the ink flows through only the established passage even if the recovery operation is repeated, leaving untouched the other portions of filter with the air layer; therefore, it is impossible to eliminate completely the air layer. Under such a condition, there is a higher probability that it takes a shorter time for the air layer (air bubble) to be grown large enough to block the ink passage, by the ambient change or the like.

The problem of the bubbles at the joint between the recording head and ink container occurs also in the integrated exchange cartridge, but in the case of this type of cartridge, the amount of generated bubbles is relatively small compared to the case of the separable-exchangeable cartridge, and in addition the filter of the recording head of the exchangeable integrated cartridge is already in the ink when the cartridge is shipped; therefore, the filter is more wettable by the ink, allowing the bubbles to be satisfactorily sucked out by the conventional recovery operation.

However, carrying out the conventional recovery operation is not sufficient to remove the bubbles in the bubble pockets created when the ink container of separable-exchangeable cartridge is exchanged. That is, since the filter of the exchangeable type recording head is exposed to the air each time the ink container is exchanged, it never becomes sufficiently wettable, and as a result the ink does not easily stick to the filter after the ink container is exchanged, making it rather difficult to remove the bubbles. Also in the separable-exchangeable cartridge, measures should be taken to prevent the interior of the apparatus, recording sheets, hands or clothing of the operator, or the like, from being contaminated by the ink leaking out of the joint between the ink container and recording head.

In other words, the joint portion between the recording head and ink container in the separable-exchangeable cartridge must satisfy the following requirements: that the recording head and ink container can be reliably connected; the recording head and ink container can be easily joined or separated (removed) so that they can be easily exchanged; and in addition, the ink be prevented from leaking after the ink container is removed.

In order to satisfy the above-mentioned requirements, a structure has been proposed in which the ink container of the separable-exchangeable cartridge is provided with an elastic valve, which is placed at the connecting portion thereof and is moved as the ink supply tube of the recording head is inserted into the ink container, to allow the ink to be supplied from within the ink container.

When such a valve member is used, the ink passage from the ink container to the supply tube of the recording head does not become straight due to the presence of the valve member, having curvatures or bents. If the bubbles come to be misplanted at such curvatures or bends of the ink passage while the recording head and ink container are replaced, it becomes difficult to remove all the bubbles by the ordinarily practiced recovery operation.

SUMMARY OF THE INVENTION

Accordingly, the present invention was made as a result of the accumulation of earnest studies of the above described problems and its primary object is to provide an ink jet recording apparatus comprising a highly reliable performance recovery means which is effective in an exchangeable ink jet cartridge in which the ink jet recording head and ink container are separately exchangeable, and recovery method for such an ink jet recording apparatus.

According to an aspect of the present invention, the ink jet apparatus comprises an ink jet head; an ink container for storing ink to be ejected out of said head; a cartridge for mounting an exchangeable ink jet cartridge; sucking means comprising a cap to be placed in contact with said head when the ink is to be sucked out of said recording head of said cartridge and a pump for generating a negative pressure, being connected to said cap; and controlling means for controlling the sucking operation carried out by said sucking means; wherein said controlling means controls said cap to be held away from said head for a predetermined duration of time after carrying out the first sucking operation following the exchange of said ink container by covering said head with said cap.

According to another aspect of the present invention, the recovery method of an ink jet apparatus comprises the steps in which: an ink container is exchanged in an ink jet cartridge comprising an exchangeable ink jet head and an exchangeable ink container containing the ink to be ejected out of said head; an ink sucking cap is placed in contact with the ejection orifice surface of said recording head; said cap is connected to a pump for generating a negative pressure, whereby the ink is sucked from said ink container; and said cap is moved away from said head to allow the ink to return to said ink container, wherein said cap is held away from said head for a predetermined duration of time.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
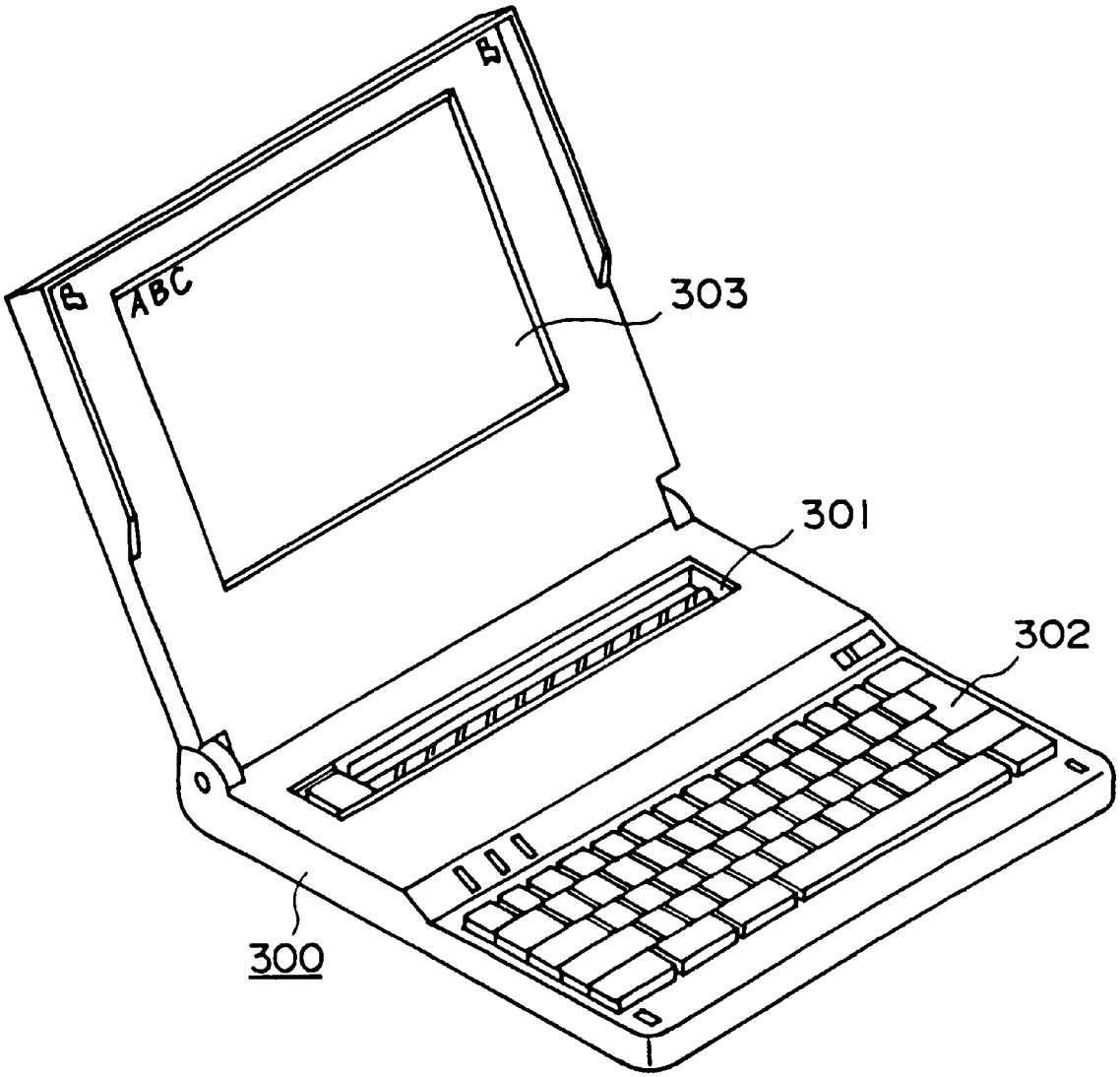
FIG. 1 is a schematic oblique view of an information processing apparatus comprising an embodiment of the recording apparatus to the present invention.

FIG. 1 is a schematic oblique view of the external view of an information processing apparatus 300 comprising the recording apparatus according to the present invention. In this drawing, a reference numeral 301 designates a printer portion; 302, a key board portion comprising the keys for inputting letters, numbers, and other characters, and the keys for issuing various commands; and a reference numeral 303 designates a display portion comprising a display.

Figure 2:
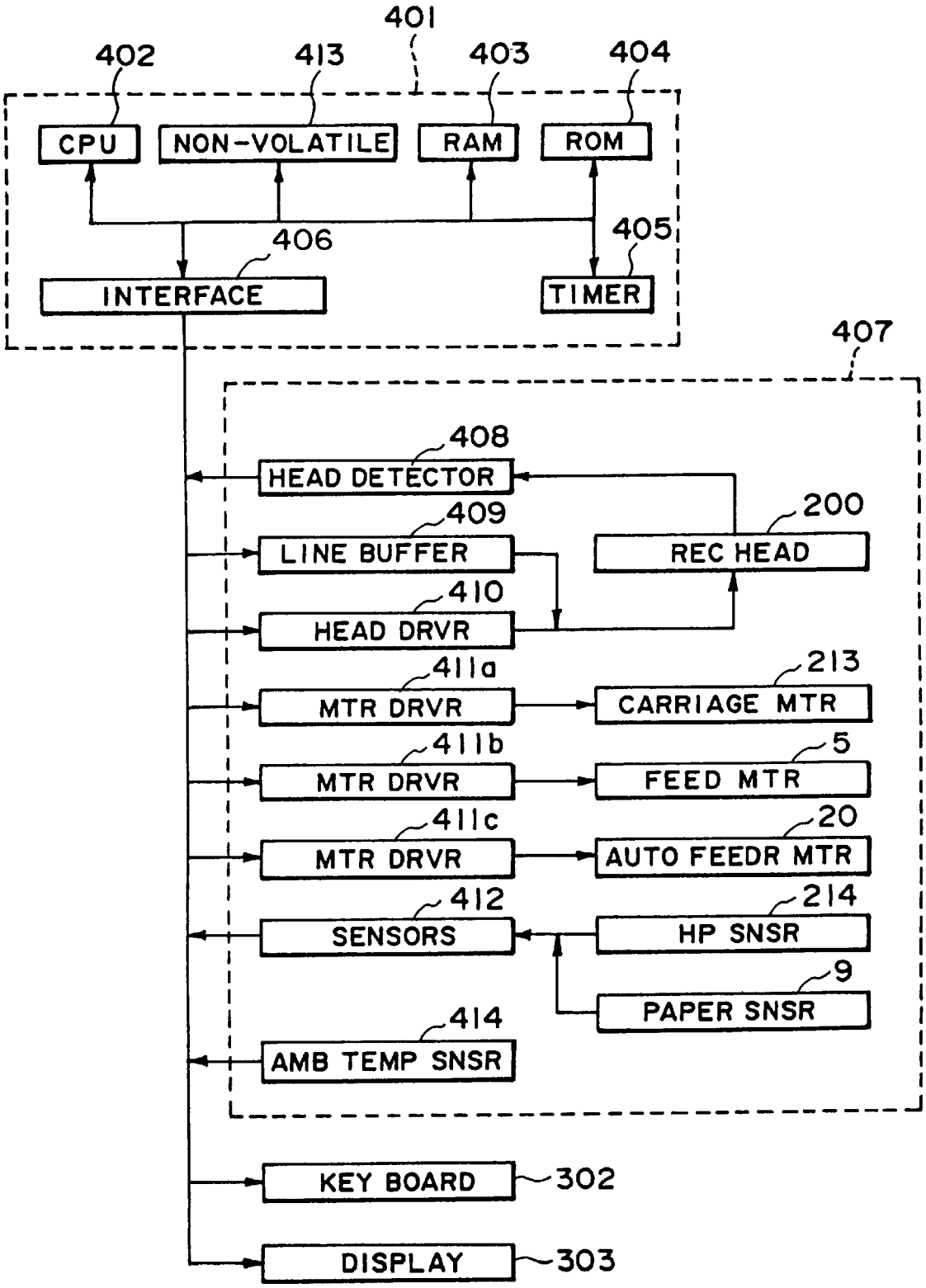
FIG. 2 is a block diagram showing the electrical circuit structure of the information processing apparatus comprising the embodiment of the recording apparatus according to the present invention.

FIG. 2 is a block diagram showing the electrical circuit structure of the information processing apparatus 300 according to the present invention. In this drawing, a reference numeral 401 designates a controller which constitutes recovery operation controlling means for controlling the recovery operation, which will be later described in detail, and also serves as the main container; 402, a CPU in the form of, for example, a microcomputer, for carrying out given operational sequences; 403, a RAM comprising areas in which the text data or image data are developed or working areas; 404, a ROM starting programs corresponding to the aforementioned sequences or fixed data such as font data; 405, a timer needed when executable cycles for the CPU 402 are created or when images are recorded by the printer portion 301; and a reference numeral 306 designates an interface portion for connecting the signals from the CPU 402 to the peripheral apparatuses. Further, a reference numeral 407 designates a controller of the printer portion 301; 408, a heat detecting portion for detecting the recording head information such as presence or absence of the recording head 200, recording head types, output values of a sensor for detecting the temperature of the recording head 200, output values of a sensor for detecting whether or not the ink is within the ink container 201; 409, a line buffer for storing the recording data for the recording head 200; 410, a head driver which supplies the recording head 200 with a recording signals or electric power; 411*a*, 411*b*, and 411*c*, motor drivers for supplying signals and electric power necessary to driving a carrier motors 213, a sheet delivery motor 5, and an automatic sheet feeder motor 20, respectively; 412, a detecting portion for detecting the outputs of sensors such as a home position sensor 214 and a paper sensor 9; and a reference numeral 414 designates an ambient temperature detecting portion for detecting the output value of the sensor which detects the ambient temperatures of the apparatus and the recording head. Though not included in the block diagram of FIG. 2, there is an electric power source for supplying the above mentioned electrical circuit with the electrical power. As for this electrical power source, a rechargeable battery, a disposable battery, or a converter for the AC power source employed when the main assembly of the information processing apparatus is installed in a stationary manner, are available.

Figure 3:
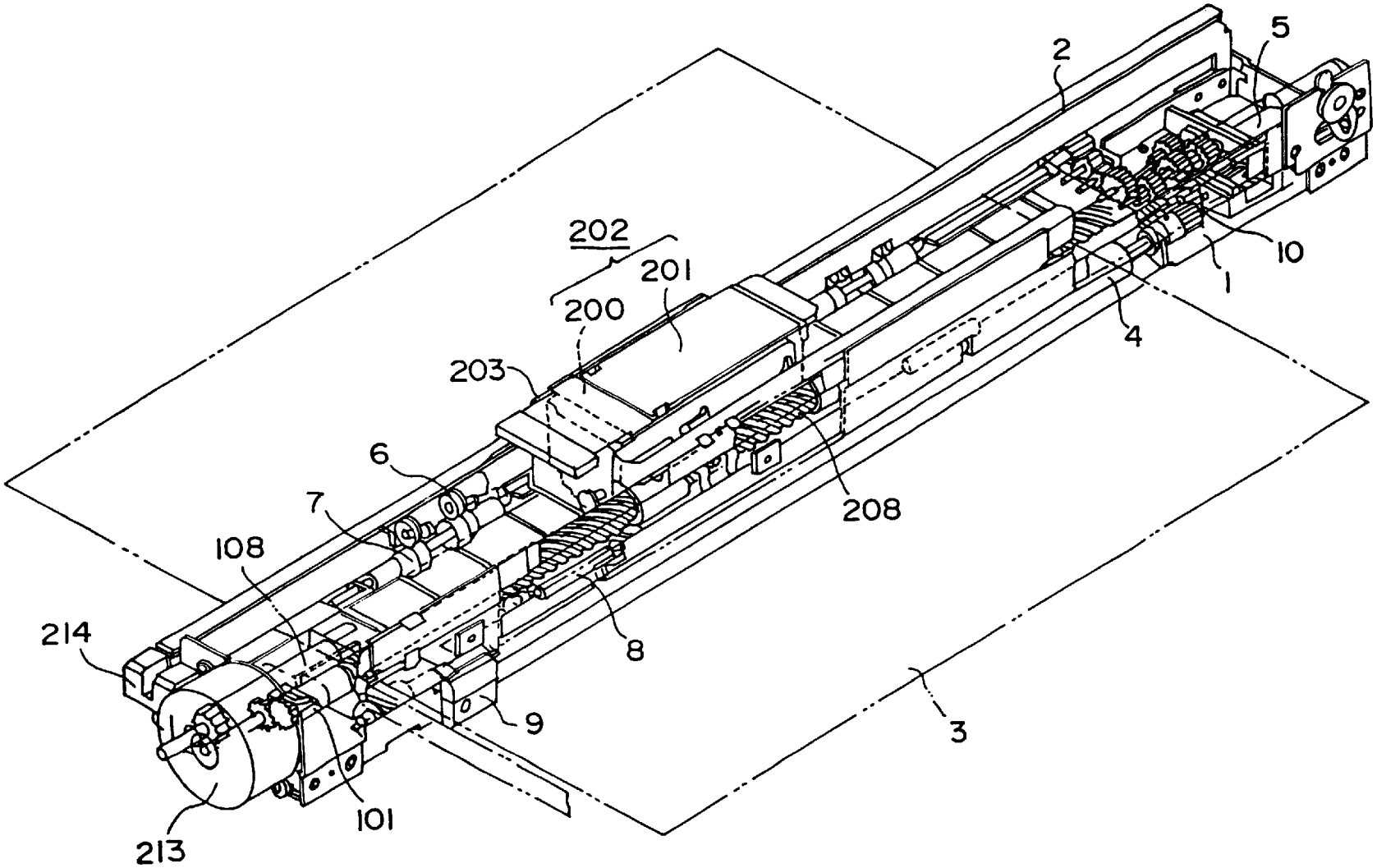
FIG. 3 is a schematic oblique view of an embodiment of the recording apparatus according to the present invention.

FIG. 3 is a schematic oblique view of the printer portion of the ink jet apparatus shown in FIG. 1. In this drawing, mounted on a carrier 203 is a cartridge type recording head 202 in which a recording head 200 constituting the recording means and an ink container 201 are connected in a manner such that each of them can be individually replaced. The carrier 203 is engaged with a lead screw 208 on the side where the recording head 200 is, so as to be movable in the axis direction of the lead screw 203, and is provided with a guide on the other side, which is engaged with a guide rail 2 formed on a chassis 1 so as to slide in the direction parallel to the axis direction of the lead screw 203. In other words, as the lead screw 208 rotates, the carrier 203 can be reciprocated in the axis direction of the lead screw 203.

The recording head 200 is driven to eject ink in response to recording signals as well as in synchronization with the reciprocating movement of the carrier 203, whereby an image equivalent to a single line of recording is formed on a recording material 3. After the single line of recording is made by the scanning movement of the carrier 203, the recording material 3 is advanced by conveying means by a distance equivalent to a single line space to be prepared for the recording of the next line, wherein the advancement of this recording material 2 is carried out by a rotary pair of a conveyer roller 4 and a pinch roller 8 pressed thereon and another rotary pair of a discharger roller 7 and a spur roller 6. The conveyer roller 4 and discharge roller (unshown) are driven by a sheet delivery motor 4, wherein the driving force is transmitted through a reduction gear train 10.

A reference numeral 9 designates a paper sensor for detecting the presence or absence of the recording material 3.

Figure 4:
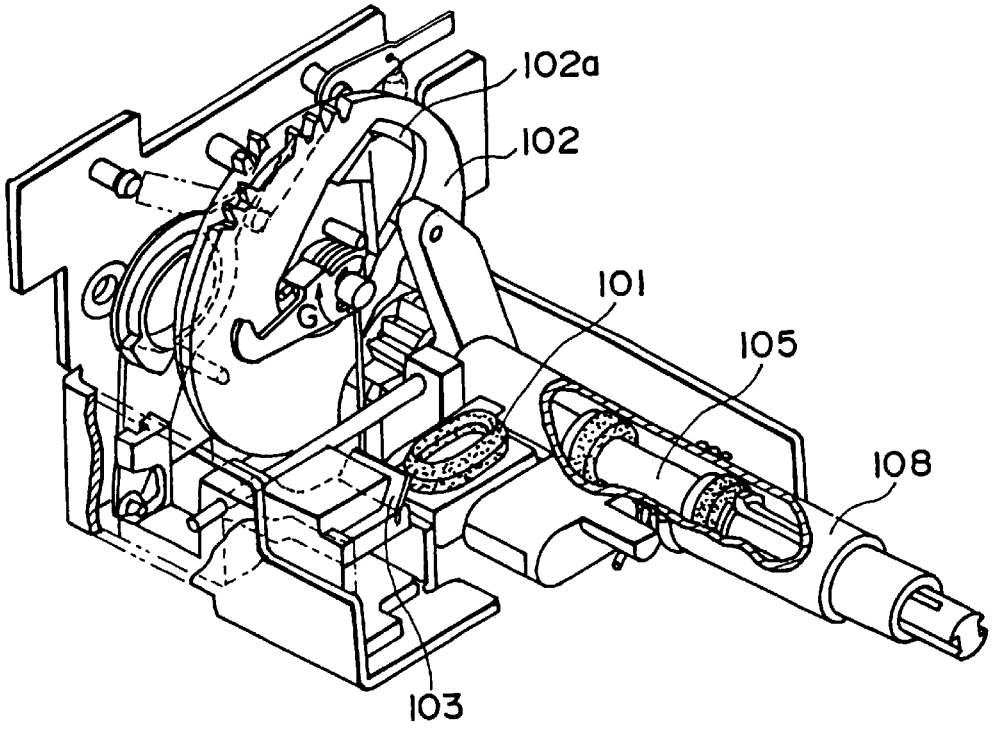
FIG. 4 is an oblique view of an embodiment of the recovery apparatus.

FIG. 4 is an oblique view of the recovery mechanism of the ink jet recording apparatus. In this drawing, the recovering mechanism comprises: a cap 101 for capping the ejection orifice surface of the recording head 200; a pump unit 108 for generating a negative pressure in the cap 101 so that the ink on the ejection orifice surface is sucked through the cap 101 to be delivered to a discharge ink absorbing member; a known cam for moving the cap 101 to and from the ejection orifice surface, for transmitting the driving force to the pump unit 108, and for driving a wiping mechanism for wiping the ink adhering to the ejection orifice surface; and a control gear 102 of the transmission mechanism comprising a gear train. Further, to the control gear 102, the rotational driving force of a carrier motor 213 (FIG. 3) is transmitted through a clutch gear (unshown). A reference numeral 103 designates a blade, which wipes clean the ink ejecting surface of the recording head 200.

Figure 5:
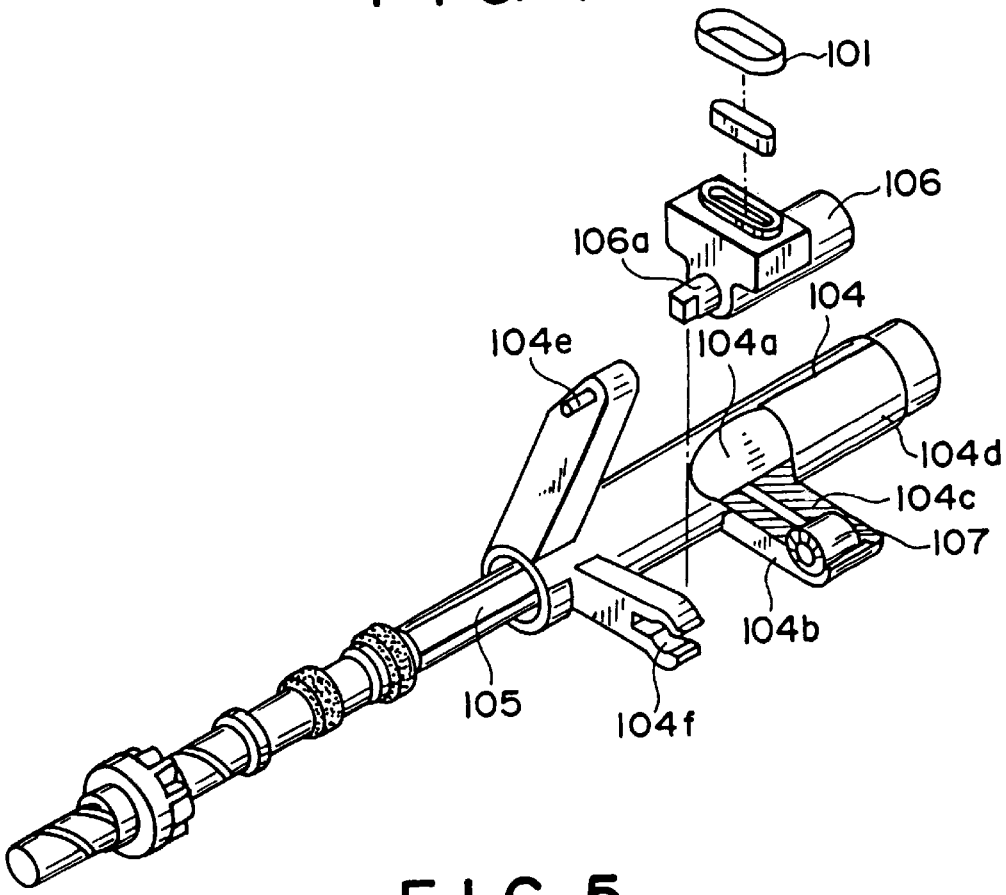
FIG. 5 is a detailed drawing of an embodiment of the pump unit according to the present invention.

The pump unit 108 is constructed in the form of a plunger pump as shown in FIG. 5.

In FIG. 5, a reference numeral 104 designate a cylinder comprising a cylinder portion 104*a* and a guide portion (unshown) for guiding a plunger 105 which will be described later, wherein a portion in the axial direction is cut away to form an ink passage; 104*b*, a cap lever holder formed in a manner so as to accommodate a cap lever seal; 104*c*, an ink sucking opening which opens at a predetermined location; 104*d*, discharge ink tube, the integrally formed end of which is inserted the discharge ink absorbing member; and a reference numeral 104*e* designates a parallel pin for opening or closing the cap, wherein when the parallel pin 104*e* is pushed by a cap opening/closing cam 102*a* of the control gear 102, the cylinder 104 rotates to open or close the cap 101, that is, to place the cap 101 firmly in contact with the ejection orifice surface of the recording head or separating it away.

Also in FIG. 5, a reference numeral 106 designates a cap lever, wherein one end thereof, the ink guide (unshown), is pressed upon the cap lever seal 107 and the other end, a rotary shaft 106*a*, is snapped in a hole 104*f* of the cylinder 104, so that the cap lever can freely rotates. The ink guide of the cap lever 106 is pressed into the cap lever seal 107, and then the cap lever seal 107 is pressed into the cap lever holder 104*b* of the cylinder 104.

Figure 6:
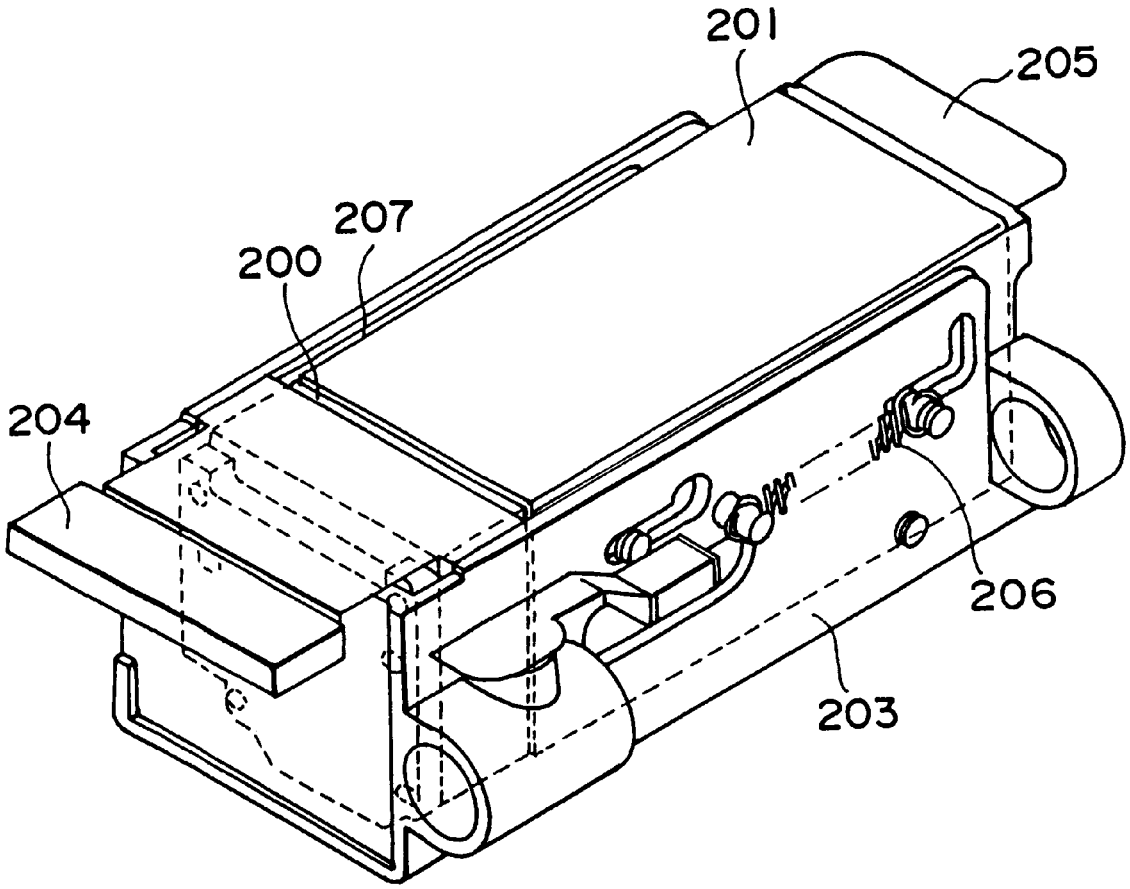
FIG. 6 is a schematic oblique view of embodiments of the cartridge type recording head and the carrier according to the present invention.

FIG. 6 is a schematic oblique view of the separable-exchangeable cartridge and the carrier, the former being mounted on the latter. In this drawing, a reference numeral 200 designates a recording head which ejects ink in response to electric signals; 201, an ink container for storing the ink and supplying the ink to the recording head 200; 203, a carrier provided in the main assemble of the recording apparatus for holding the recording head 200 and ink container 201 and scanning the surface of the recording material; 204, a head lever for retaining or releasing the recording head; 205, an ink container lever for loading or unloading the ink container 201; 206, a head holder spring for securing the recording head 200 onto the carrier 203, and a reference numeral 207 designates a ink container case for holding the ink container 201.

Figure 7:
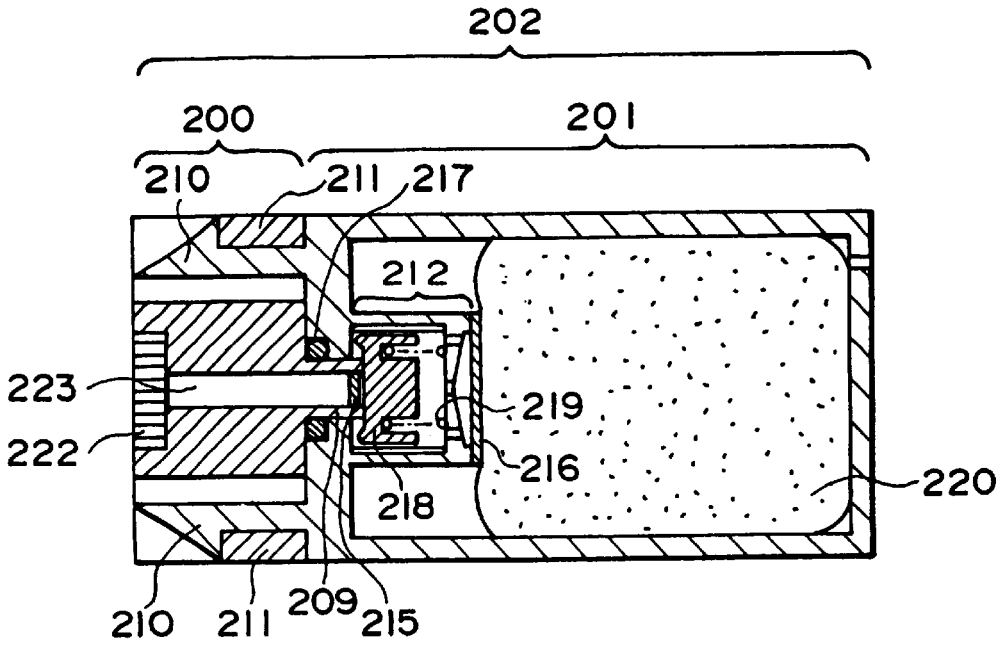
FIG. 7 is a sectional view of an embodiment of the recording cartridge, with the recording head portion and ink container portion being connected.
Figure 8:
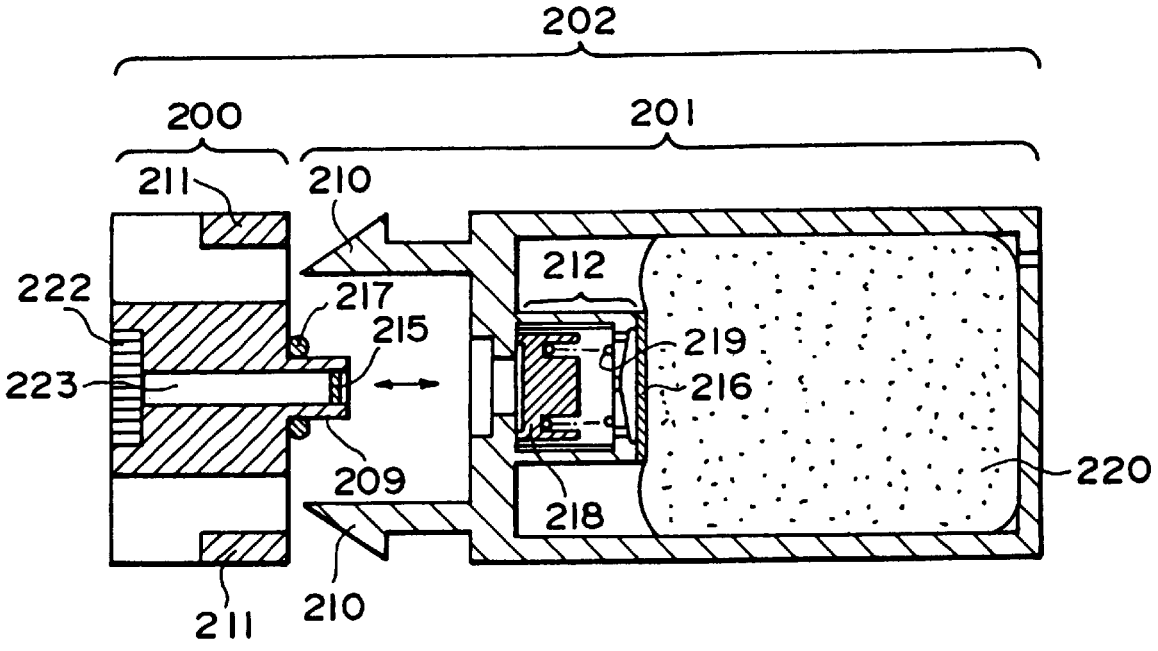
FIG. 8 is a sectional view of the embodiment of the recording cartridge, with the recording head portion and ink container portion being separated.

FIGS. 7 an 8 are schematic sectional views of the separable-exchangeable cartridge 202, wherein the recording 200 and ink container 201 are joined in FIG. 7 and are separated in FIG. 8. In these drawings, the recording head 200 comprises: an ink ejection orifices 222; an ink passage 223 for leading the ink to the ink ejection orifices 222; an ink supply tube 209 which is engaged with the ink container 201 so that the ink is supplied to the recording head 200; and a filter 215 provided within the ink passage 223 for preventing foreign matter or the like from reaching the ejection orifices 222.

The ink container 201 comprises: an ink absorbing member 220 for storing the ink; a valve mechanism 212 for opening or closing the port where the ink supply tube 209 is inserted, wherein the valve mechanism 212 further comprises an elastic sealing member 218 and a spring member 219 for generating a force to press the elastic sealing member toward the port (toward the left of the drawing); and a filter 216 provided at the interface between the valve mechanism and the ink absorbing member 220.

The recording head 200 and ink container 201 are fixedly joined as claw members 210 provided in a pair on the ink container 210 are inserted into anchoring members 211 provided in a pair on the portions of the recording head 200. At this time, the ink supply tube 209 is inserted into the port of the ink container 201, pushing the elastic sealing member 218 of the valve mechanism 212 in the right direction of the drawing against the pressure of the spring member 219, whereby the leading end of the ink supply tube 209 is positioned within the ink container 201, enabling the ink to be supplied to the recording head 200.

Further, an O ring 217 is provided in a manner to fit around the ink supply tube 209 of the recording head 200, for preventing the ink from leaking out of the opening of the ink container while the recording head 200 and ink container 201 are in the joined state.

As the recording head 200 and ink container 201 are separated, the elastic sealing member 218 of the valve mechanism 212 closes the opening of the ink container 201, preventing thereby the ink from leaking out of the ink container 201.

On the other hand, the filter 215 provided within the ink supply tube 209 of the recording head 200 comes in contact with the air as the ink container 201 is separated. As shown in FIG. 8, when the ink within the ink container 201 is depleted, the ink container 201 is exchanged with a fresh ink container 201, which is joined with the recording head 200 in the same manner as shown in FIG. 7.

As was stated hereinbefore, when the fresh ink container 201 is joined with the recording head 200, a large amount of bubbles become trapped between the filter 209 of the recording head 200 and the valve mechanism 210 (more specifically, the elastic sealing member 218) of the ink container 201. Further, the trapped bubbles sometimes migrate into the ink passage of the valve mechanism 212. Such bubbles cannot be removed by the ordinary recovery operation.

Hereinafter, the recovery operation according to the present invention will be described in detail.

Figure 9:
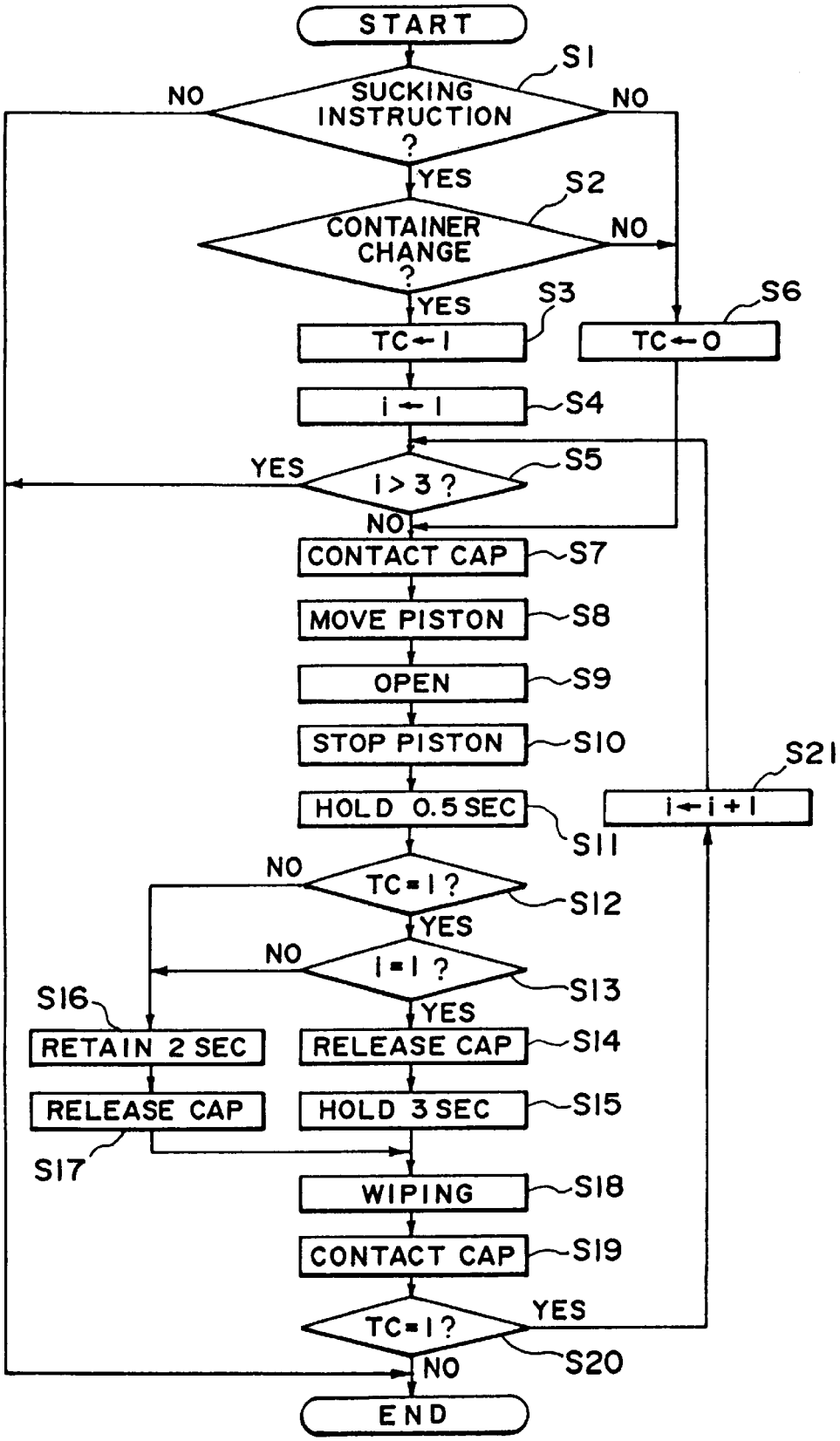
FIG. 9 is a recovery operation flow chart for the embodiment of the present invention.

Referring to FIG. 9, a recovery sequence for exchanging the ink container will be described. First in a step S1, it is discriminated whether or not a sucking instruction is present. If there is, a step S2 is followed and if there is not, the sequence which will be described hereinafter is not followed, ending thereby the operation. In the step S2, it is discriminated whether or not the present sucking instruction has been issued as a result of the detection of the ink container exchange. Here, if it is discriminated that the sucking instruction was issued after the ink container was exchanged, a step S3 is taken and if not, a step S7 is taken. In the step S7, a "0" is placed in an ink container exchange flag TC, and then, a step S7 is taken (when "0" is in the TC, it means that the ink container has not been exchanged).

Now, with regard to the discrimination of whether or not the ink container has been exchanged, any generally conceivable means is acceptable. For example, a microswitch or the like may be provided on the carrier 203 shown in FIG. 3 or 6, on the surface where the ink container is placed, wherein each time the ink container is joined or disjoined, the output of this switch is reversed, indicating thereby the ink container exchange; in order to detect the ink container exchange, a pair of a light emitter and a light receptor may be positioned across the carrier, adjacent to the carrier passage, wherein the discrimination is made by reading the output of the receptor which reverses depending on whether or not the light beam between the pair is interrupted; the discrimination may be made based on the weight of the recording head and ink container mounted on the carrier; a pair of electrodes may be positioned with a predetermined interval, in the ink passage, wherein the resistance value between the pair of electrodes is used for the discrimination of the ink container exchange; or many other various means.

Next, in the step S3 which is followed when it is determined in the step S2 that the ink sucking instruction has been issued after the ink tank exchange. "1" is placed in the ink container exchange flag TC (TC: tank change), and continuingly, in a step S4, a variable i is substituted by "1," wherein the variable i indicates the ordinal number of the sucking operation to be carried out next. Continuingly moving to a step 5, where it is discriminated whether or not the variable i is more than "3," wherein when the variable i exceeds "3," it is unnecessary to continue the sucking operation, stopping thereby the operation, and when the variable i does not exceed "3," the step S7 is followed to carry out the sucking operation. The fact that the variable i exceeds "3" means that more than three ink containers have been joined with the recording head. From the standpoint of the reliability of the recording head, the practical service life of the recording head in this embodiment is assumed to be equivalent to three ink containers full of ink. In other words, when the reliability of the recording head is further improved, the value with which the variable i is compared may be set higher.

From the step S7 to a step S10, an operational sequence of the pump unit 150 is shown. Next in a step S11, the pump operation is suspended till the ink will have been completely sucked, whereby the ink sucking operation is prevented from being interrupted midway. Continuingly in a step S12, it is discriminated whether the ink container exchange flag TC indicates "1" or "0." If the TC does not show "1," the sequence skips to a step S16 and if it shows "0," the sequence advances to a step S13. In the step S13, it is discriminated whether or not the value of the variable i which indicates the ordinal number of the sucking operation is "1." Here, if i is not "1," the sequence jumps to the step S16 and if i is "1," a step S14 is followed.

That the step S14 is followed means that the following conditions have been satisfied: TC=1 and i=1. In other words, the sucking operation to be carried out is the first one after the ink container exchange; therefore, immediately after the sucking operation is completed, the cap, having been covering the ejection orifice surface, is released in the step S14 and held released for three seconds in the step S15, whereby the ink having advanced through the interface between the ink container and recording head, halfway into the ink passage within the recording head is returned toward the ink container due to the negative pressure of the ink container, leaving practically no ink in the ink passage within the recording head. However, at the interface between the ink container and recording head, a metallic mesh filter is provided on the recording head side and the ink retaining force is generated by the meniscus of the ink formed in this filter; therefore, the ink does not retreat beyond this point toward the ink container. The reason why such operations are performed as in the steps S14 and S15 is as follows; when the ink is drawn into the recording head side by the sucking operation after the ink container exchange, the air trapped between the recording head and ink container is sucked into the recording head side, whereby the ink passage of the recording head is filled with the ink which contains air bubbles, and this air bubbles containing ink which is drawn into the ink passage of the recording head by positively carrying out the sucking operation can be cleared out of the ink passage within the recording head by allowing the ink to return to the ink container side. In other words, by carrying out again the sucking operation after changing the internal state of the ink recording head from the state in which the ink and air bubbles co-exist within the ink passage to the state in which only the air is present in the ink passage, only the air is first drawn out of the ink passage and then only the ink is drawn into the ink passage, filling it. Next, following the operation of the above-mentioned pump unit, the ejection orifice surface is wiped in a step S18 and is covered by the cap in a step S19, to be followed by a step S20. In the step S20, the value of the flag TC is once again confirmed, wherein when the value is "1," the sucking operation is to be repeated; therefore, a step S21 is followed.

In the step S21, the value of the variable i, which indicates the ordinal number of the sucking operation, is increased by "1" and the sequence skips back to the step S5.

Now, when the answers are "no"s in both the steps S12 and S13, in other words, when it is not the time for the ink container exchange or when it is not the time for the first sucking operation even though it is the time for the ink container exchange, the sequence jumps to the step S16, where even after the sucking operation is completed in the step S11, the cap is held for two seconds as it covers the ejection orifice surface. After recording the state of full negative pressure in the pump unit and cap, the cap is released in a step S17.

Figure 15:
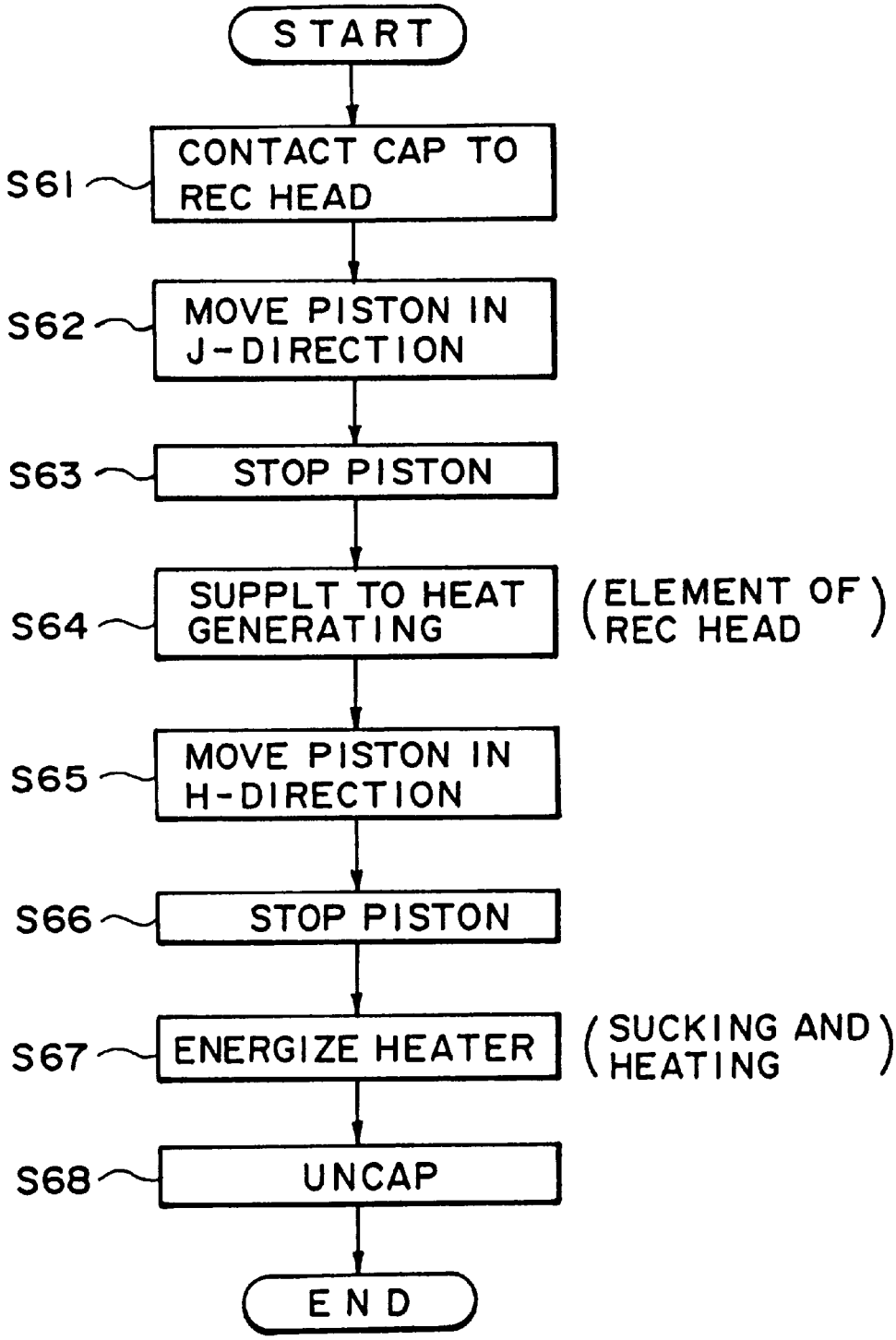
FIG. 15 is a flow chart for the sequence for the sucking and heating operations in the embodiments of the present invention.

Described in the foregoing is the flow of the recovery operation according to a preferred embodiment of the present invention, but the number of consecutive sucking operation at the time of the ink container exchange and the duration in which the cap is held in contact with the ejection orifice surface may appropriately selected depending on the types of the ink jet cartridges or suction pumps, not being limited to the values indicated in FIG. 15.

As described hereinbefore, according to the present invention, the stable performance of the ink jet cartridge comprising an exchangeable ink container can be realized by improving slightly the operational sequence of the recovery suction pump, without leaving small bubbles in the ink stream when the ink container is joined (exchanged) and without wasteful ink consumption. This means the present invention can be an extremely effective means for downsizing the recording apparatuses in the future.

The recovery operation described hereinbefore eliminates the presence of bubbles by a single sucking operation, but the presence of bubbles in the recording head can be more reliably eliminated by carrying out the recovery operation described hereinafter, which uses the changes in the states of the ink and bubbles with the passage of time.

Figure 11:
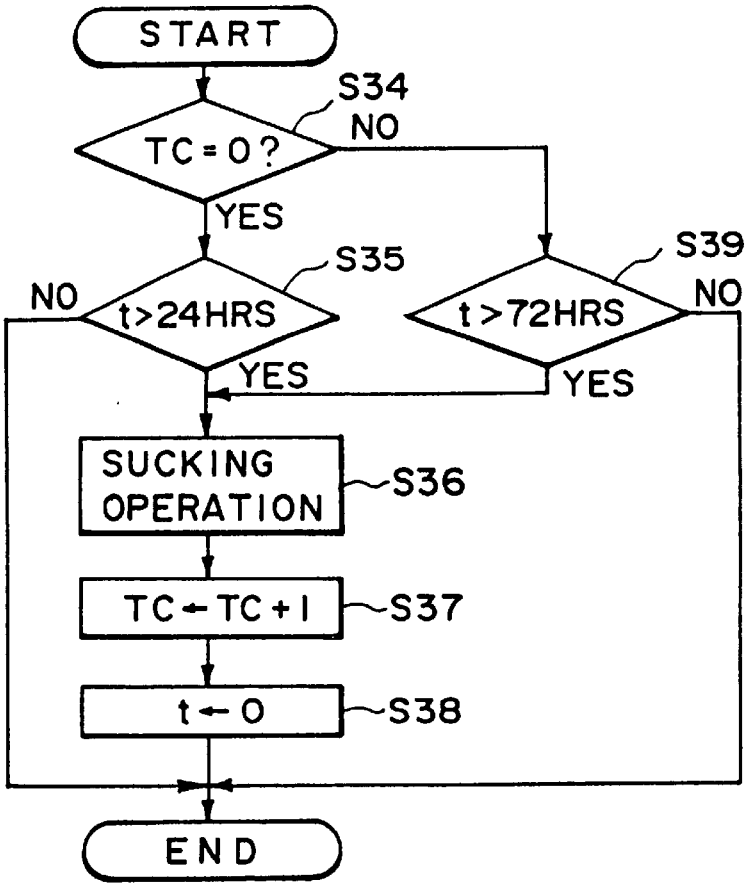
FIG. 11 is a flow chart of the operational control sequence for the recovery apparatus when the ink container of the first embodiment is exchanged.

Referring to FIG. 11, the first and second predetermined durations of time (Ta) and (Tb), which are the durations of time elapsed after the previous recovery operation was carried out, are 24 and 72 hours, respectively. First, in a step S34, it is discriminated whether or not the ink container exchange flat TC is "0." Here, that the TC is "0" means that a timer 405, a clocking means, is checked for the first time after the ink container exchange. This ink container exchange flag TC is processed within a non-volatile memory 413 shown in the block diagram of FIG. 2. When the TC is "0," in other words, when this is the first time the clocking means t is checked after the ink container exchange, the sequence advances to a step S35, and when the TC is not "0," that is, when this is not the first time the clocking means t is checked after the ink container exchange, the sequence jumps to a step S39.

Here, it is to be noted that the clocking means is reset each time the recovery apparatus is operated.

In the step S35, it is discriminated whether or not the time t (elapsed time since the last recovery operation is carried out) of the timer, the clocking means exceeds 24 hours. When it exceeds 24 hours, the step S36 is taken, where the sucking operation as the second recovery operation is carried out by the pump shown in FIG. 5 and then, a step S37 is followed. When t does not exceed 24 hours in the step S37, this operation of sucking pump is ended.

On the other hand, in the step S39, it is discriminated whether or not t exceeds 72 hours. When it is not more than 72 hours, the step S36 is followed where the sucking operation as the third recovery operation is performed and then the step S37 is followed. When t is less than 72 hours, this operation of the sucking pump is ended.

In the step S37, the value of the ink container exchange flag TC is increased by "1" and then a step S38 is followed. In the step S38, the clocking means t is reset to "0" and then this operation of the sucking pump is ended.

The reason why the recovery operation by suction is carried out after the predetermined duration of time is as follows.

When the recording head is filled with the ink by carrying out the recovery operation immediately after the ink container exchange, small bubbles are contained in the ink, and when the recovery operation is carried out with presence of such ink, it is rather difficult to remove the micro-bubbles clinging to the ink passage walls or the like of the recording head. However, the minute bubbles dispersed in the ink gradually combine with the adjacent bubbles to grow into larger bubbles. The bubbles which have grown to a substantially large size can be easily discharged out of the recording head by the ordinarily practiced recovery operation.

Therefore, to remove reliably the bubbles from within the recording head during the ink container exchange operation, the ink is first allowed to retreat to the ink container by releasing the cap after the first sucking operation and then the second sucking operation is carried out to fill the recording head. By this process, the recording head is basically filled with the ink in which no bubble are present but it is conceivable that bubbles of extremely small sizes may still present. And in order to handle such a case, an additional sucking operation, that is, the third sucking operation, is carried out after the elapse of the predetermined duration of time, whereby the recording head is filled with the ink containing no bubbles.

Hereinafter, a recovery operation involving a color ink container will be described.

There are occasions when two or more ink containers containing different colors (for example, four colors of black, yellow, magenta, and cyan) are alternated during a recording operation using the separable-exchangeable miniature recording head according to the present invention. The viscosities, volatilities, or the likes of these color inks are not necessarily the same; therefore, the amount of the ink dischargeable by a single recovery operation is different, depending on each ink container.

In this case, when the embodiment of recovery operation described hereinbefore is adopted as the control means for operating the automatic recovery apparatus during the ink container exchange, it becomes impossible to remove completely the bubbles present in the ink passage, depending on the viscosities or volatilities of the inks, whereby the ejection failure is more probable to occur. In other words, it is necessary to adjust the operating timing of the automatic recovery apparatus, depending on the viscosities and volatilities of the inks, in more practical terms, depending on the ink color. In this embodiment, the recovery operation is to be carried out more frequently when the ink color is black than when it is another color.

As for the means for detecting the ink color, any known methods as follows is acceptable: a method in which the ink container and carrier are provided with one of a pair of electrodes, respectively, and the resistance value of the electrode on the ink container side is made different depending on the ink color, to discriminate the colors; a method in which a portion of the joint between the ink container and carrier is given a different shape depending on the ink color to discriminate the colors; or a like method.

Figure 10:
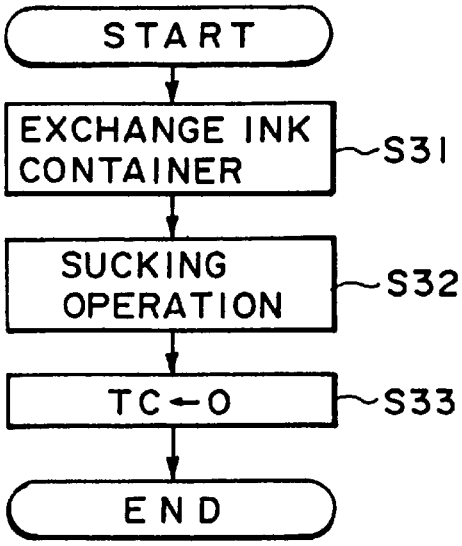
FIG. 10 is a flow chart of the entire control sequence for exchanging the ink container in the first, second or third embodiment.

Next, referring to FIGS. 10 and 12, the operation of the recovery apparatus in this embodiment will be described. First, during the ink container exchange, after it is determined in a step S31 of FIG. 10 that the ink container has been exchanged, the sequence moves to a step S32 where the sucking operation is carried out. In a step S33, which is the step after the sucking operation, "0" is placed in the ink container flag TC and this sequence is ended.

Figure 12:
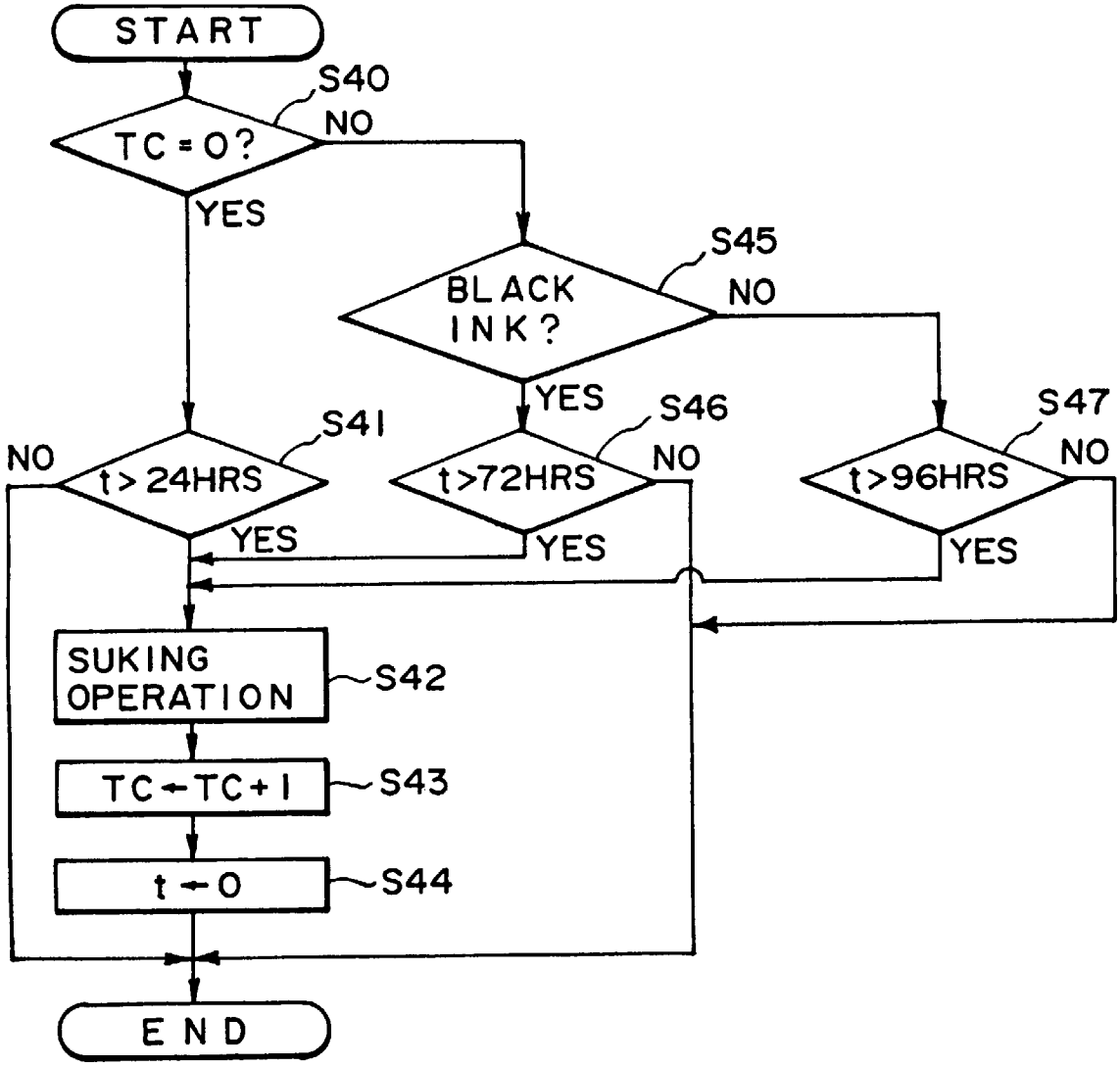
FIG. 12 is a flow chart of the operational control sequence for the recovery apparatus when the ink container of the second embodiment is exchanged.

Next, referring to FIG. 12, the Ta is set at 24 hours and the Tb is set at 72 and 96 hours. In a step S40 in FIG. 12, it is discriminated whether or not the value of the ink container exchange flag TC is "0." When the TC is "0," the sequence advances to a step S41, and when not, a step S45 is taken.

In the step S41, it is discriminated whether or not the time t of the timer 405, the clocking means, is more than 24 hours. When it is over 24 hours, the sequence advances to a step S42 where the sucking operation is carried out and then a step S43 is followed. When in the step S41 the time t is not over 24 hours, this operation of sucking pump is ended.

In the step S45, it is discriminated whether or not the ink color is black. When it is black, the sequence advances to a step S46, and when not, a step S47 is followed.

In the step S46, it is discriminated whether or not the time t is more than 72 hours. When it is more than 72 hours, the sequence goes to a step S42 where the sucking operation is carried out and then the sequence goes to a step S43. When in the step S46 the time t is not more than 72 hours, this operation of the sucking pump is ended.

On the other hand, in the step S47, it is discriminated whether or not the time t is more than 96 hours. When it is more than 96 hours, the sequence advances to a step S42 where the sucking operation is carried out and then a step S43 is followed. When in the step S47, the time t is not more than 96 hours, this operation of the sucking pump is ended.

In the step S43, the value of the ink container exchange flag TC is increased by "1" and the sequence advances to a step S44. In the step S44, the clocking means t is reset to "0" and then this operation of the sucking pump is ended.

Next, a recovery operation in which ambient conditions are taken into consideration will be described.

there are occasions when the ink jet recording apparatus comprising the super-small recording head with separable-exchangeable ink container according to the present invention is used after it is left in an environment in which the temperature is as low as 5° C. In such a case, the bubbles in the ink supply passage are not likely to grow. Therefore, when under this condition the recovery sequence as described in the preceding two embodiments is carried out as the control means for controlling the automatic recovery apparatus during the ink container exchange, the apparatus comes to be operated more times than necessary for the adequate recovery operation. As a result, the ink is going to be wasted.

On the other hand, there are occasions when the above described ink jet recording apparatus is used after being left in an environment in which the temperature is as high as 30° C. In this case, the rate at which the bubbles in the ink supply passage grow becomes extremely high. Therefore, when under such a condition the recovery sequence as described in the preceding two embodiments is carried out as the control means for controlling the automatic recovery apparatus during the ink container exchange, the bubbles cannot be completely removed, causing the occurrence of the ejection failure to be more probable.

Thus, it becomes necessary to adjust the timing for the automatic recovery operation, depending on the environment in which the ink jet recording apparatus was left before the beginning of the recording operation, current.

As for means for detecting the ambient temperature, ordinary methods may be adopted. For example, it is sufficient to provide a thermistor in the ink jet recording apparatus.

Next, referring to FIGS. 10, 13, and 14, the operational sequence of this embodiment will be described. During the ink container exchange, first, in the step S31 of FIG. 10, the ink container exchange is recognized and then the step S32 is followed where the sucking operation is carried out. In the step S33 which comes after the sucking operation, "0" is placed in the ink container exchange flag TC and this operation of sucking pump is ended.

Figures 13, 14:
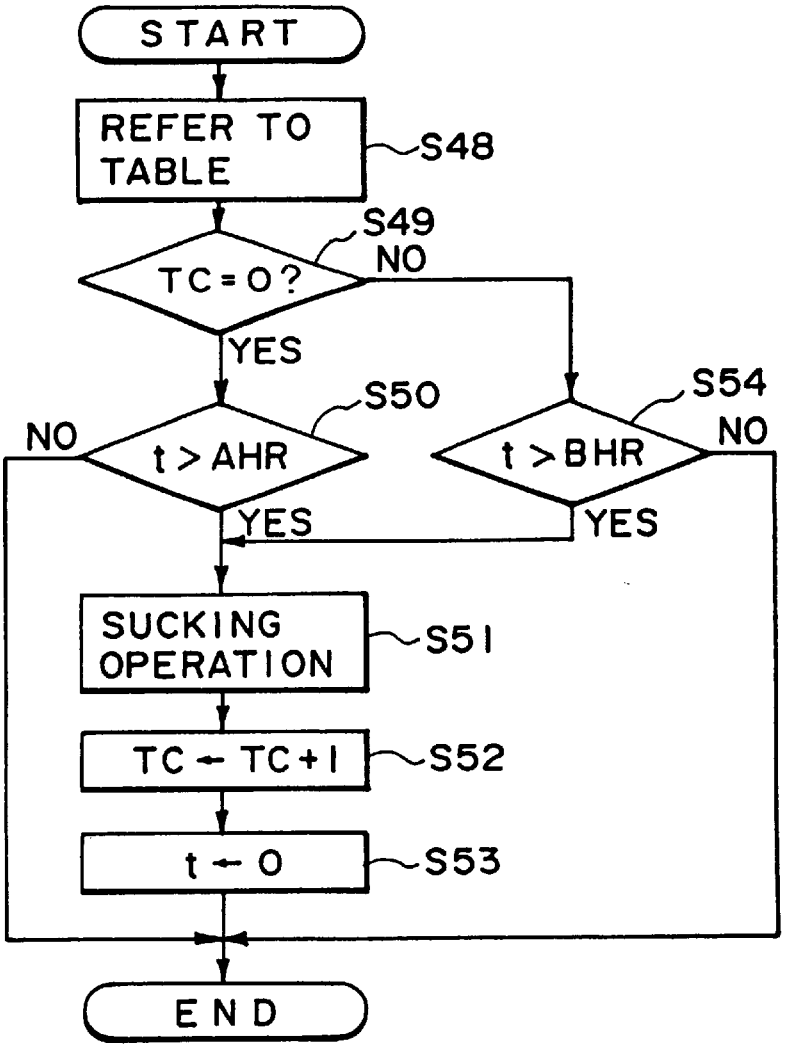
FIG. 13 is a flow chart of the operational control sequence for the recovery apparatus when the ink container of the third embodiment is exchanged.
FIG. 14 is a table showing the relation between the control timing for the operation of the recovery apparatus and a thermistor temperature T while the ink container of the third embodiment is exchanged.

Next, referring to FIGS. 13 and 14, the description will be continued. In FIGS. 13 and 14, values A and B are the values of Ta and Tb, respectively, wherein FIG. 14 is a table to be used for determining the values of Ta and Tb with reference to a temperature T detected by the aforementioned thermistor. First, in a step S48, the values A and B are selected according to the temperature T detected by the thermistor, referring to the table.

Next, in a step S49, it is discriminated whether or not the value of the ink container exchange flag is "0." When the TC is "0," the sequence advances to a step S50, and when not, a step 54 is followed.

In the step S50, it is discriminated whether or not the time t is more than A hours (for example, when the value of the temperature T detected by the thermistor is 23° C., A is 24 hours). When it is more than a hours, the sequence advances to a step S51 where the sucking operation is carried out and then to a step S52. When the time t is not more than A hours, this operation of the sucking pump is ended.

On the other hand, in the step S54, it is discriminated whether or not the time t is more than B hours. When it is more than B hours, the sequence goes to a step S51, where the sucking operation is carried out, and then to a step S52. When in the step S54 the time t is not more than B hours, this operation of sucking pump is ended.

In the step S52, the value of the ink container exchange flag TC is increased by "1" and then the sequence moves to a step S53. In the step S53, the aforementioned clocking means t is reset to "0" and this operation of the sucking pump is ended.

As was described hereinbefore, according to this embodiment, the time elapsing before the recovery apparatus is to be operated is set up in multiple steps; therefore, not only can the bubbles in the recording head be reliably discharged, but also the ink is prevented from being wastefully consumed, that is, consumed more than necessary, during the recovery operation.

Now, while the recording it not going on, the ejection orifices are covered with the cap but it is not the case that the recording liquid is perfectly prevented from evaporating only because they are covered. In other words, as far as the ink passages in the ejection nozzles adjacent to the ejection orifices are concerned, the recording liquid cannot be completely prevent from evaporating; therefore, the recording liquid in these areas increases its viscosity or solidifies. When the recovery operation is carried out under such a condition, even through it can flow the recording liquid itself, it cannot completely remove the recording liquid with the increased viscosity and the solidified recording liquid, which are present adjacent to the ejection orifices, failing thereby to recover sufficiently the recording head performance. As a result, such a situation occurs in which the recovery operation must be repeated several times. Here, "sufficient recovery" means that the recording head sufficiently regains its characteristics related to the direction in which the ink droplets are ejected and the amount by which the ink is ejected, during the recording operation following immediately after the recovery operation.

Further, in the low temperature environment, the entire recording liquid within the system decreases its viscosity, which invites the decline in the flowability of the recording liquid during the recovery operation also. Therefore, it is possible that the satisfactory state of recovery cannot be accomplished by the recovery means which depends solely on the flow of the recording liquid, unless such a recovery operation is repeated for a while.

In contrast to the above described means, a proposal has been made in which the elements for generating the ejection energy are driven at the same time when the recovery operation is carried out. However, as the downsizing of the recording apparatus progresses, it becomes necessary to downsize also the apparatus for the recovery operation. As a result, the amount of recording liquid dischargeable by a single recovery operation and the force affordable for discharging the ink also become small. Therefore, there may be a situation in which this means of driving the ejection energy generating elements at the same time when the recovery operation is carried out is insufficient.

In order to handle such a situation, the following steps may be taken: after closing the recording liquid sucking opening which is in communication with the ink jet recording head, the piston is moved in the vacuum pump constituting the recording liquid sucking apparatus, in order to create a state of vacuum within the cylinder of the pump, but just before the piston begins to be moved, the energy for ejecting the recording liquid is given, whereby the increased viscosity of the ink within the nozzles which have not been used before this operation can be reduced; the fluidity of the ink is increased by increasing the ink temperature. In addition, since this energy is applied just before the recording liquid is made to actually flow, the application efficiency is extremely high. These steps are extremely effective for improving the efficiency with which the recording liquid is next sucked into the pump. Further, the energy for ejecting the recording liquid is applied also while the recording liquid is sucked, therefore, this effect becomes more apparent.

further, the piston movement and energy application are not allowed to occur at the same time; they are differentiated in terms of timing, which brings forth the following large effects. That is, when the piston of the suction pump is moved, a power source (mainly, a motor) is needed, and when the recording apparatus is small, the power consumed for moving the piston alone is relatively large, affording thereby little to be spared. Therefore, if the energy is applied while the piston is moved, the current demand may exceed the capacity of the apparatus. Thus, differentiating the timings for two actions is effective to preventing the current demand from exceeding the capacity of the power source. The smaller the apparatus is, the more important this point is.

As for the amount of energy to be applied, when the operation of the suction pump is not limited to once; when the operation is to be repeated several times, it does not need to be the same each time; such a method in which an appropriate amount of energy is selected in response to the state of each suction pump operation is more effective. In other words, there are many such cases in which the amount of energy may be differentiated between when the piston begins to be moved for reducing the internal pressure of the pump and when for discharging the recording liquid; various amounts of energy may be matched with each of the several operations repeated by the suction pump. The amount of energy to be applied may be determined in consideration of such factors as the structure of the recording head to be used; the ways the recording head is disposed in the apparatus; and ambient conditions such as temperature, humidity, or the like of the environment in which the recording apparatus is to be placed.

Hereinafter, this embodiment will be described referring to drawings. FIG. 15 is a flow chart showing the operational flow of this embodiment.

To begin with, in a step S61 after a command for sucking operation is issued, the cap is placed in contact with the ejection surface of the ink jet recording head. Next, in step S62, the piston is first moved in a J direction to discharge the ink within the pump chamber. As the piston is moved as far as the end of its travel at the rear, the movement of the piston is stopped in a step S63. This stoppage of the piston is also a preparation for next movement, a reverse movement of the piston, and during this stoppage the power is supplied to the ink-ejecting exothermic elements of the ink jet recording head in a step S64; preheating occur. Here, according to Table 1, the power is supplied in the form of 500 pulse signals. After the preheating is over, a step S65 is followed where the piston is moved in the reverse direction. And in a step S66, the piston is stopped as soon as the retainer of the piston passes the ink passage, and next in a step S67, the power is supplied to the ink-ejecting exothermal elements of the recording head, wherein the heating and sucking operations are simultaneously carried out. As soon as the sucking and heating are ended, a step S68 is followed where the cap is moved away from the ejection surface of the ink jet recording head.

TABLE 1

| Pre-heating | Heating-while-sucking |
|---|---|
| 500 | 500 |

Since the recovery (sucking) operation of this embodiment is carried out in the above-mentioned manner, the timings for both preheating the heating-while-sucking operations are different from the timing for the rotation of the timing gear for driving the pump; while the heating goes on, the timing gear does not move. Therefore, it is unnecessary to increase the capacity of the power source. Further, the number of pulses for the preheating and heating-while-sucking operations have only to be set at an appropriate value according to the characteristics of the recording head and recording system.

Table 2 shows various settings for the number of pulses for the preheating and heating-while-sucking operations while the recovery-by-sucking operation is carried out. The energy for heating can be more effectively used by selecting such seatings.

TABLE 2

| Pre-heating | Heating-while-sucking |
|---|---|
| 500 | 1000 |

Immediately after exchanging the ink container, in order to generate a continuous flow between the ink in the ink container and the ink in the nozzles of the ink jet recording head, it is necessary to carry out a sucking operation such as described above. Also in this case, carrying out the above described preheating and sucking-while-heating can more reliably eliminate the bubbles and recover the ejection performance. However, in this case, the complete ink flow cannot be established by a single sucking operation; several sucking operations must be repeated. It is unnecessary to set all the numbers of heating pulses for these sucking operations to be the same; they may be set at various values. In this embodiment, three sucking operations are needed and the heating for each sucking operation is done according to the number of pulses shown in Table 2.

TABLE 3

| No. of sucking actions | Pre-heating | Heating-while-sucking |
|---|---|---|
| First | 0 | 50 |
| Second | 100 | 100 |
| Third | 500 | 1000 |

Since the timing for activating the power source of the recovery apparatus and the heating timing are differentiated, it is possible to reduce the capacity of the power source. Therefore, this embodiment offers a system capable of recovering the performance of even the recording head in which the ink container may be frequently exchanged.

While the invention has been described with reference to the structures disclosed herein, it is not confined to the details set forth and this application is intended to cover such modifications or changes as may come within the purposes of the improvements or the scope of the following claims.

What is claimed is:

1. An ink jet apparatus for use with an ink jet head with an ejection orifice for ejecting ink and an exchangeable ink container for containing ink to be supplied to said ink jet head, the apparatus comprising:

a cap for capping said ejection orifice;

sucking means for sucking ink from said ejection orifice when said cap caps said ejection orifice after said ink container is exchanged; and control means for controlling said cap and said sucking means so that said sucking means sucks ink form said ejection orifice when said cap caps said ejection orifice;

wherein the ink container includes an ink absorbing member, said control means controls said sucking means so that said sucking means sucks ink from said ejection orifice when said cap caps said ejection orifice after said ink container is exchanged, and then said control means controls said cap to be separated from said ejection orifice and held away therefrom, without laterally moving said ink jet head relative to said cap, for a predetermined duration of time, during which a sucking operation is not performed by said sucking means and ink drawn into the ink jet head in the sucking operation is returned toward the ink container by negative pressure produced by the ink absorbing member, and after said predetermined duration of time said control means controls said cap and said sucking means so that said cap again caps said ejection orifice and said sucking means again sucks ink from said ejection orifice.

2. An ink jet apparatus according to claim 1, wherein after an elapse of the predetermined duration of time following the sucking operation, said control means controls said cap and said sucking means so that said sucking operation is repeated.

3. An ink jet apparatus according to claim 1, wherein said sucking means comprises a pump having a piston which performs reciprocating movement so as to exert suction on the ink; and wherein said control means controls said ink jet head to eject the ink immediately before said piston begins the reciprocating movement and/or while the sucked ink is transferred after the movement of the piston is stopped.

4. An apparatus according to claim 1, wherein the ink jet head contains a thermal energy generating element for generating thermal energy to eject the ink.

5. An ink jet apparatus according to claim 1, wherein said apparatus is usable with an exchangeable ink jet cartridge having said ink jet head.

6. A recovery method for an ink jet apparatus for use with an ink jet head with an ejection orifice for ejecting ink and an exchangeable ink container for containing ink to be supplied to said ink jet head, the ink container including an ink absorbing member, said recovery method being performed after said ink container is exchanged and said ink jet apparatus including a cap for capping said ejection orifice and sucking means for sucking ink from said ejection orifice, said method comprising:

a first sucking step in which said sucking means sucks ink from said ejection orifice when said cap caps said ejection orifice after said ink container is exchanged;

a non-sucking step, after said first sucking step, in which said cap is separated from and held away from said ejection orifice for a predetermined duration of time during which said ink jet head is not moved laterally relative to the cap, and during which said sucking means does not perform a sucking operation, whereby ink drawn into the ink jet head in the sucking operation is returned toward the ink container during said predetermined duration of time by negative pressure produced by the ink absorbing member; and a second sucking step, after said non-sucking step, in which said cap again caps said ejection orifice and said sucking means again sucks ink from said ejection orifice.

7. A recovery method of an ink jet apparatus according to claim 6, further comprising a step in which after an elapse of the predetermined duration of time following said second sucking step, said first sucking step, said non-sucking step and said second sucking step are repeated.

8. A recovery method of an ink jet recording apparatus according to claim 6, wherein said sucking means comprises a pump having a piston which performs reciprocating movement so as to exert suction on the ink; and wherein each of said first sucking step and said second sucking step further comprises a step in which said ink jet head is made to eject the ink immediately before said piston begins the reciprocating movement and/or while the sucked ink is transferred after the movement of the piston is stopped.

9. A method according to claim 6, wherein said apparatus is usable with an exchangeable ink jet cartridge having said ink jet head.

* * * * *

UNITED STATES PATENT AND TRADEMARK OFFICE

CERTIFICATE OF CORRECTION

PATENT NO. : 6,149,261
DATED : November 21, 2000
INVENTOR(S) : Kuwabara et al.

Title page,
FOREIGN PATENT DOCUMENTS,
"51-69675" should read -- 5-169675 --.

Column 1,
Line 19, "comprises" should read -- comprise --.

Column 3,
Line 31, "be" should read -- can be --.

Column 5,
Line 39, "a" should be deleted; and
Line 42, "motors" should read -- motor --.

Column 7,
Line 18, "an" should be deleted.

Column 8,
Line 44, ""1,"" should read -- "1", -- ; and
Lines 48, 49 and 51, ""3,"" should read -- "3", --.

Column 9,
Line 1, ""0."" should read -- "0". -- and
""1,"" should read -- "1", -- ;
Line 2, ""0,"" should read -- "0", --;
Line 5, ""1."" should read -- "1". -- and ""1,"" should read -- "1", --; and
Line 6, ""1,"" should read -- "1", --;
Line 31, "this" should read -- these --;
Line 46, ""1,"" should read -- "1", --; and
Line 67, "selected" should read -- be selected --.

Column 10,
Line 22, ""0."" should read -- "0". --;
Line 27, ""0,"" should read -- "0", --; and
Line 30, ""0,"" should read -- "0", --.

UNITED STATES PATENT AND TRADEMARK OFFICE

CERTIFICATE OF CORRECTION

PATENT NO. : 6,149,261
DATED : November 21, 2000
INVENTOR(S) : Kuwabara et al.

It is certified that error appears in the above-identified patent and that said Letters Patent is hereby corrected as shown below:

Column 11,
Line 8, "present." should read -- be present. --; and
Line 56, ""0."" should read -- "0". --, and
""0,"" should read -- "0", --;

Column 12,
Line 19, "there" should read -- There --; and
Line 46, "current." should read -- currently. --.

Column 13,
Line 2, ""0."" should read -- "0". --;
Line 3, ""0,"" should read -- "0", --; and
Line 8, "a" should read -- A --.

Column 14,
Line 24, "further," should read -- Further, --; and
Line 34, "to" should read -- for --.

Column 15,
Line 3, "occur." should read -- occurs. --; and
Line 27, "the" should read -- and --.

Column 16,
Line 30, "form" should read -- from --.

Signed and Sealed this

Twenty-seventh of November, 2001

*Attest:*

Nicholas P. Godici

*Attesting Officer*

NICHOLAS P. GODICI
*Acting Director of the United States Patent and Trademark Office*